US007537414B1

(12) United States Patent
Raike

(10) Patent No.: US 7,537,414 B1
(45) Date of Patent: May 26, 2009

(54) SMALL PNEUMATIC WAVE GENERATOR

(76) Inventor: George W. Raike, 26 Bent Tree La., Hilton Head, SC (US) 29926

( * ) Notice: Subject to any disclaimer, the term of this patent is extended or adjusted under 35 U.S.C. 154(b) by 451 days.

(21) Appl. No.: 10/993,727

(22) Filed: Nov. 19, 2004

Related U.S. Application Data

(60) Provisional application No. 60/618,025, filed on Oct. 12, 2004.

(51) Int. Cl.
*A47K 3/10* (2006.01)

(52) U.S. Cl. ..... 405/79; 4/491

(58) Field of Classification Search ..... 405/79; 4/491
See application file for complete search history.

(56) References Cited

U.S. PATENT DOCUMENTS 4,515,500 A * 5/1985 Bastenhof ..... 405/79
4,522,535 A * 6/1985 Bastenhof ..... 405/79

* cited by examiner

*Primary Examiner*—Sunil Singh
(74) *Attorney, Agent, or Firm*—Jerry Semer

(57) ABSTRACT

The device is a wave generation system for bodies of water such as pools. At the deep end of the pool there is a set of air tight caissons. These caissons have an open bottom and allow the water of the pool to flow within. Pressurized air from a high pressure blower is introduced into these caissons via a duct. The duct, which passes through the caissons, is perforated on its top to allow the pressurized air from the blower to distribute itself evenly over the surface of the water. The air fills the caisson forcing the water out the open bottom of the caisson and into the pool causing the wave. These waves can be used as in a normal wave pool or used to power a river type ride.

6 Claims, 10 Drawing Sheets

SMALL PNEUMATIC WAVE GENERATOR

Continuation-in-part (CIP) of prior application No. 60/618,025, filed Oct. 12, 2004.

FIELD OF THE INVENTION

The present invention relates generally to a pneumatic wave generation for pools and more particularly to pneumatic wave generation systems that generate waves in pools as small as a back yard pool.

BACKGROUND OF THE INVENTION

Wave generation systems are the featured amusement at many amusement parks and aquatic theme parks throughout the world. In such applications various mechanical and pneumatic devices and apparatus have been utilized to engage and displace water at one end of the pool to create a surface wave pattern. A conventional wave generation system may be housed at a deep end of the pool with multiple caisson chambers. A ventilation system is provided within each caisson above the surface of the water therein. A source of forced air capable of effecting aspiration by applying compressed air to the surface above the water surface in the chamber is applied by conduit system. When the caissons are actuated with pressurized air the water level therein is driven down out of a lower caisson passage way and into the pool thereby creating the intended wave disturbance.

U.S. Pat. No. 4,812,077 to Raike discloses a wave generation system of the type mentioned above. Another patent to Raike, U.S. Pat. No. 6,729,799 also describes the above type of wave generation system. In these systems, a pneumatic system including a motor driven fan that communicates selectively with duct lines to caissons through a pair of two position air directed valve assemblies. Selective actuation of the two position air directional valve assemblies between the caisson chambers allow the waves to be generated in many alternately wave shapes and patterns augmenting the utility of the installation and its amusement value to users. Waves produced in water theme parks typically operate two to three hundred hours per month. The system put forth in the two patents to Raike is well designed for a large amusement park.

However, the objective of this invention is to create a smaller pool size, usually around twenty four feet wide to eighty feet long and having a volume of water around 27,000 gallons for use in the residence, apartment, condominiums complexes and is intended for only occasional use. The 24 feet in width was chosen because that in the minimum width pool to produce a true sinusoidal was of one meter in height. One meter in height wave are ideal for acceptable raft riding and will break into a roller wave and advance to the zero water depth. Eighty feet pool length has been shown to be a good short length and slope to provide and safe and enjoyable board surfing in a shot wave pool. The inventor believes the twenty four feet by eighty feet pool represents the minimum size for a small pool with satisfactory waves with a safe and acceptable bottom slope. To achieve this objective of the pool for residential uses, pneumatic compressor and control power must run on 120 volts ac, the typical house current.

Another objective of this system is to create waves of various patterns. This is done in the commercial systems by having two or more caissons that are pressurized alternately. For the smaller pool one can use two caissons which are energized alternately or in a given sequence to produce waves in various patterns. Instead of using a valve, usually positioned above the caisson, to pressurize and depressurize the caisson in the inventor's system, the high pressure blower has a valve built within the blower assembly, a duct selector that allows for pressurizing and decompressing the duct and therefore the caisson. Supplemental air release is provided on the duct with a valve assembly at the end of the duct.

What allows the above objective to be achieved is the duct used to energize the caisson is perforated with openings along the upper half of the duct. In the conventional system shown in U.S. Pat. No. 4,812,077 to Raike, above referenced, the large volume of pressurized air necessary to rapidly charge the caisson is injected into the caisson by a nozzle positioned above the water level. The pressurized air, thus, is not evenly distributed over the surface of the water within the caisson and its focused entry into the water tends to cause turbulence as the water level is pressured downward. Undesirable turbulence degrades the quality of the generated wave and represents a system loss of pneumatic efficiency that is likewise undesirable. Thus, the need exists for a wave generator that can equally distribute and disperse pressurized air over the surface of the water within a caisson so as to result in minimal losses from turbulence and maximum pneumatic efficiency.

In the inventor's system, the pressurized air is introduced into the caisson via a duct that is perforated with openings on the top half of the duct. This duct allows air evenly distributed throughout the caisson and eliminates turbulence. By preventing turbulence the pneumatic system becomes more efficient. Due to the increase in efficiency, less air is need to move the same amount of water which allows for reducing the construction height of the caisson above water level thereby reducing the volume of space to be energized with pressurized air. This not only cuts down on the construction cost but also makes the pool much more economic when used. The decrease in the volume of air need because of the increase in pneumatic efficiency makes a small wave pool for residential use possible. The lesser volume of air necessary decrease the blower size and the caisson size thus lowering the cost of installation. This along with the lowering of cost to operate due to the smaller blower make the wave pool economical for a residential operation.

One of the major problems in adapting the existing wave generators like the one in U.S. Pat. No. 4,812,077 to Raike to a smaller scale is that the housings in which the caissons are deployed are relatively large and raise above the pools deck at the deep end. As a result, steps must be incorporated into the pool deck in order to allow for the users to transverse the perimeter of the pool. The size of the caisson housing in a conventional wave generator is a function of the relatively large air displacement requirements by the state of the art due to the turbulence caused by the injection of air and bends in the ducts. Since the cycle time of charging each caisson with pressurized air and discharging the generated wave from one caisson and exhausting the caisson is significantly short on the order of 2 seconds or less, a relatively large and excessive volume of pressurized air must be quickly injected into the caisson in order to correspondingly effectively quick movement of the water level downward. This also makes the air compressor much larger and uneconomical to purchase or use for a small installation. It is thus the objective of the invention to reduce the amount of air required to charge a caisson in a wave generating system. Such a reduction in volume of air would reduce the size of the caisson air chamber allowing for reduction of the vertical height and the lowering of the cost to build said pools. Additionally the reduction of the volume of air required to charge the wave generation caisson would enhance the system efficiently and allow the use of a smaller energy efficient fan system. In the conventional wave generation system, the large volume of pressurized air necessary to rapidly charge the caisson is injected into the caisson by a nozzle positioned above the water level causing turbulence as explained above. This turbulence lessens the efficiency of the system and necessitates a large volume of air to produce the wave. Thus, an objective of the system is to produce a wave generator that can equally distribute and dispense pressurized air over the surface of the water within the caisson so that the resulting minimal loss from turbulence and maximum pneumatic efficiency. Further, in order to supply the excessive quantity of pressurized air into the caisson, current system employs a high capacity fan system which distributes the air to the caisson by an extensive system of large conduits or ducts. Such fans are expensive and noisy in operation and have high power utilization rates resulting in undesirable increase in the cost of operating the wave generation system. Thus, the objective of the invention is to create a wave generator that produces a quieter, low powered fan unit that efficiently distributes pressurized air into the caisson through an efficient, bend free conduit system. The feature that allows this to be done is a duct system used to energize the caisson is perforated with openings along the upper half of the duct. The duct allows air to evenly distribute throughout the caisson and eliminates turbulence and maximizes efficiency. This permits less air to be needed and allows for reduced construction height of the caisson above the water level thereby reducing the volume and space to be energized with air pressure. This lesser air pressure, of course, means that a smaller far more efficient fan unit can be used.

SUMMARY OF THE INVENTION

The invention is a wave generation system for bodies of water such as pools. At the deep end of the pool there is a set of air tight caissons. These caissons have an open bottom and allow the water of the pool to flow within. Pressurized air from a high pressure blower is introduced into these caissons via a duct. The duct, which passes through the caissons, is perforated on its top to allow the pressurized air from the blower to distribute itself evenly over the surface of the water. The air fills the caisson forcing the water out the open bottom of the caisson and into the pool causing the wave. These waves can be used as in a normal wave pool or used to power waves in a river type ride.

DETAILED DESCRIPTION OF THE PREFERRED EMBODIMENT

Figure 1:
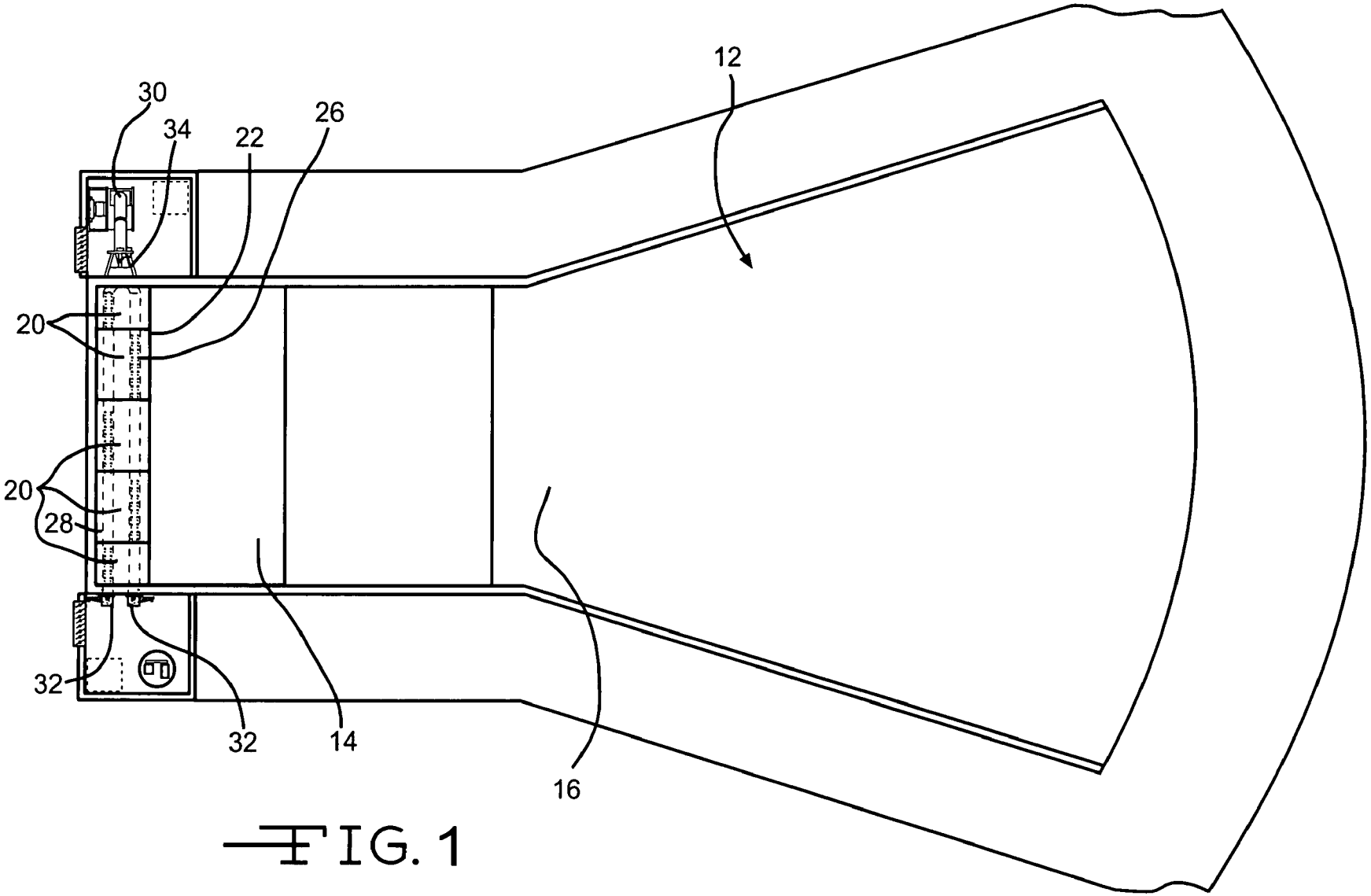
FIG. 1 is a top view of a wave pool with the invention installed.
Figure 2:
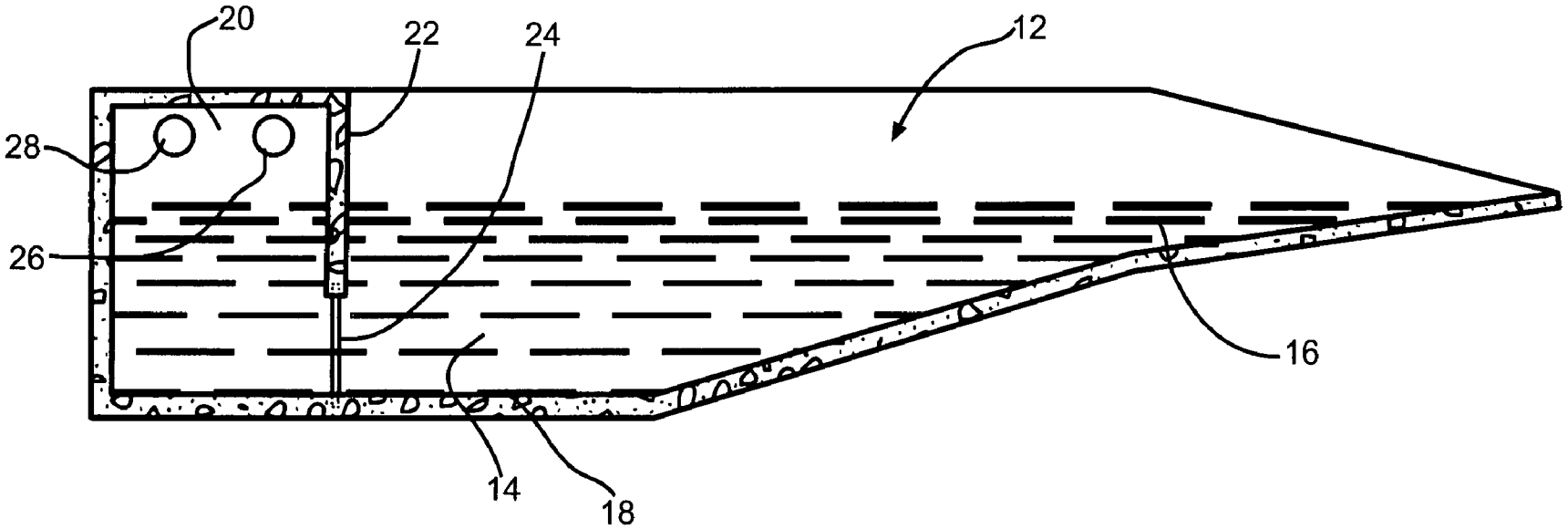
FIG. 2 is a cutaway side view of the wave pool of FIG. 1.

FIGS. 1 and 2 show the present invention, a pneumatic wave generator for a small installation. FIG. 1 shows a pool and the wave generation system comprising of a hydraulic system and pneumatic system. The pool 12 includes a deep portion 14 having substantially a square configuration and shallow portion 16 longitudinally opposite the deep portion 14. The pool 12 includes a bottom 18 with the greatest depth at the deep portion 14 and a shallow portion 16 that slopes upward to a zero depth.

In the preferred embodiment the pool would in its minimum size be twenty four feet by eighty feet. The twenty four feet wide is the minimum width for a wave pool to create a true sinusoidal wave of one meter in height. The one meter high wave are the size ideal for raft riding and will break into a roller wave and advance to zero depth. The eighty feet length is the minimum length for the slop of the bottom of the pool to allow the wave to go to zero depth that allows board surfing safely.

FIG. 1 shows the caissons 20. This FIG. 1 shows five caissons 20, which is the number ideal for a small installation, however, this number can vary from installation to installation. FIG. 2, a cutaway view of the pool 12 shows that the caissons 20 are basically cubical in structure. The caissons 20 extend above the water level of the pool 12 and extend down to the bottom 18 of the pool with the front wall 22 having a submerged passageway 24 near the bottom 18 the pool 12. The water from the pool 12 can flow through this submerged passageway 24 partially filling the caisson 20.

Figure 6:
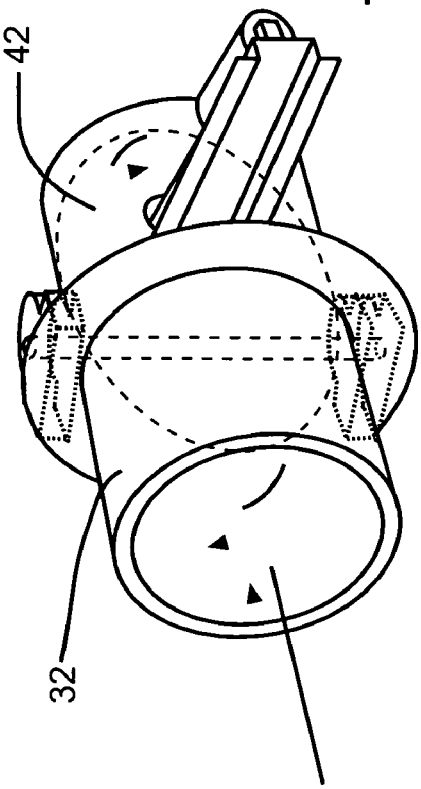
FIG. 6 is a perspective view of the pressure relief valve.

FIGS. 1 and 2 also shows ducts 26 and 28 running through the caissons 20 above the water line. These carry air from the high pressure blower 30 into the caisson 20. The high pressure air forced into the caisson 20 forces the water in the caisson 20 downward and causes it to pass out through the submerged passageway 24. This water that passes through the submerged passageway 24 forms the wave upon the pool 12. At the ends of the ducts 26 and 28 is a pressure release valve 32. This pressure release valve 32 is shown in FIG. 6. This pressure release valve 32 exhausts air from the caisson 20. When the pressure release valve 32 is opened, air from the caisson 20 flows into the ducts 26 and 28 again and is exhausted by the pressure valve 32.

Figure 3:
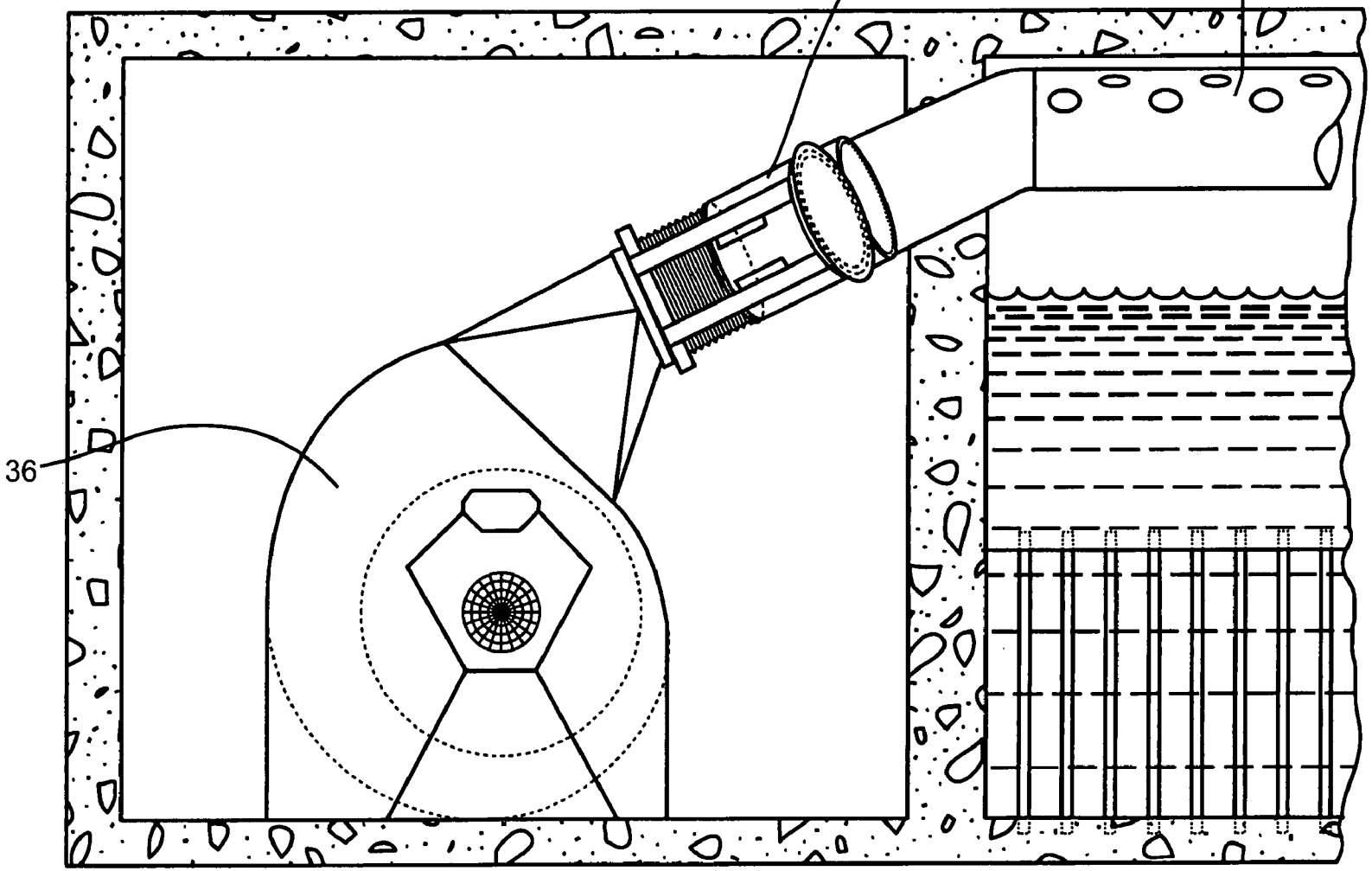
FIG. 3 is a side view of the blower and the blower valve and a portion of the first caisson.
Figure 3A:
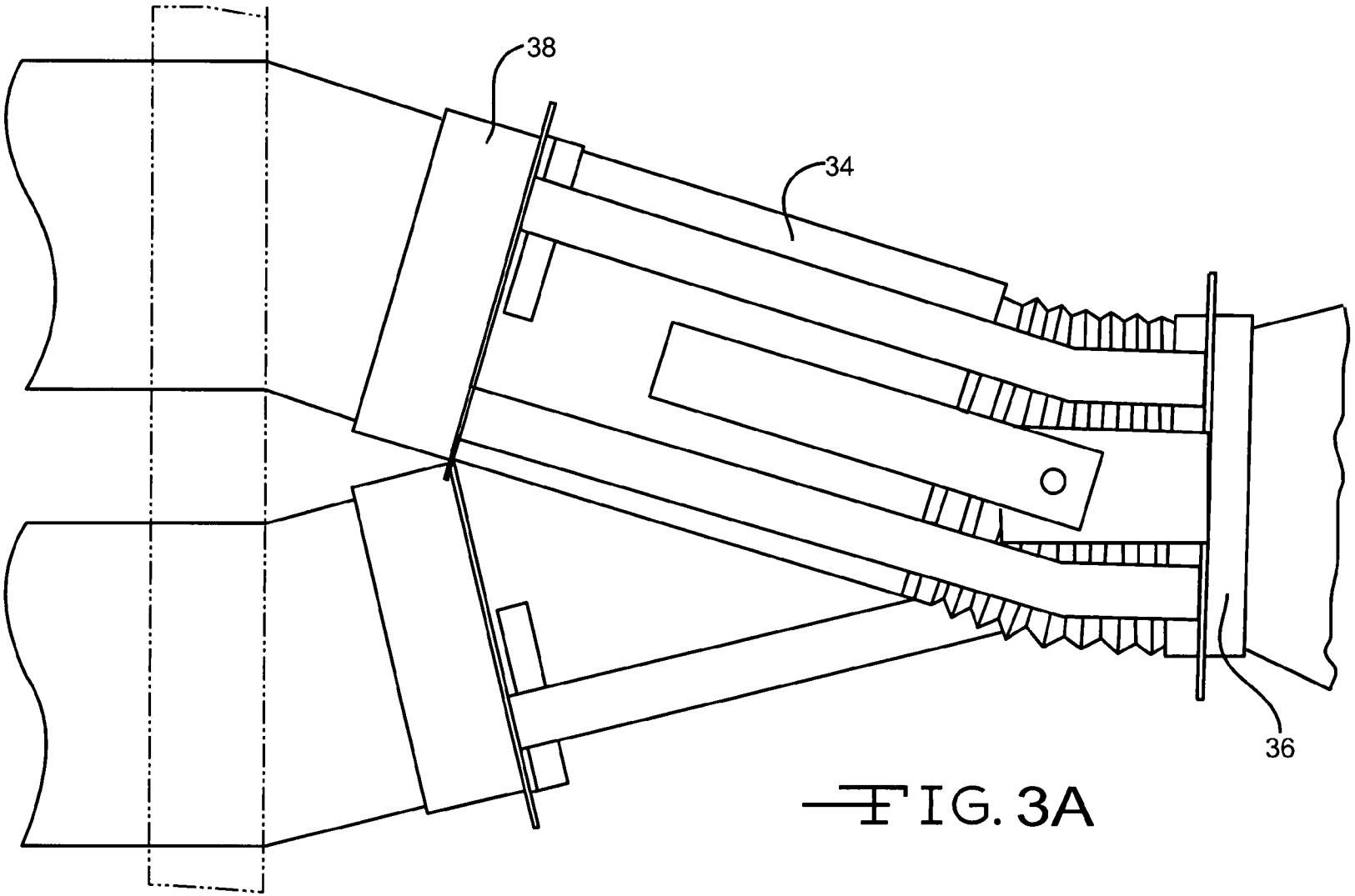
FIG. 3A is a side view of the blower valve.

Some of the air is also exhausted through the blower valve 34 shown in FIGS. 3 and 3A. Blower valve 34 connects the high pressure blower 30 alternately to the ducts 26 and 28 as shown in FIGS. 3 and 3A. FIG. 3 is a side view that shows the blower valve 34 hooking the high pressure blower to the ducts 26 and 28. FIG. 3A is a top view of blower valve 34. In FIG. 3A blower valve's inlet 36 is attached to the high pressure blower 30. Blower valve's outlet 38 shifts between attaching to duct 26 and duct 28. In FIG. 3A the blower valve's outlet 38 is attached to duct 26 and duct 28 is open.

When duct 28 is opened it means that air will be exhausted from the caissons 20 which duct 28 services. When the blower's valve's outlet 38 is attached to duct 26 it means that air is being forced into the caissons 20 which duct 26 services. The blower valve 34 moves between the two ducts 26 and 28 very rapidly. The timing is generally one to one and one-half seconds for the air to be injected into the caissons 20 and then one to one and one-half seconds to allow the air to exit. This leaves very little time to fill the large caissons 20 with air and push the water into the wave form. Therefore, the high speed blower 30 must be able to produce large volumes of high pressure air. As I pointed out above, inventor's new system with perforated straight ducts 28 and 26, increases the efficiency of the pneumatic system by approximately 25 percent. This means the size of the caissons 20 can be cut down by at least 25 percent and it also means that the high pressure blower 30 has to move 25 percent less air. Thus, a smaller size high pressure blower 30 can be used which will reduce the cost of the installation and operation. Also, the caissons 20 themselves can be reduced in size also reducing a manufacturing cost. In the traditional wave generating system shown in U.S. Pat. No. 4,812,077 the air is allowed to escape through the same opening in which the air is injected. In applicant's system, the air in the caissons 20 escapes through the openings 40 in the perforated ducts 26 and 28. The numerous openings 40 in the perforated ducks 26 and 28 create a much larger open area than the opening through which the air is injected and exhausted in U.S. Pat. No. 4,812,077. Thus, the air will more easily escape in this new system. This is further enhanced by the inventor, not only allowing the air to escape at the blower valve, but also placing on the duct 26 and 28 a pressure release valve 32 witch each cycle is opened to allow the air to escape. This better system of exhausting the air causes the pneumatic system to be much more efficient. The added efficiency, of course, lowers the size of the high pressure blower 30 necessary and also requires the high pressure blower 30 to use less effort and thus last longer. It also allows for the caissons 20 to be reduced in size, thus cutting down on the manufacturing cost and the higher efficiency means that there will be less power needed to produce the wave and thus the operating expenses would be less.

Figure 5:
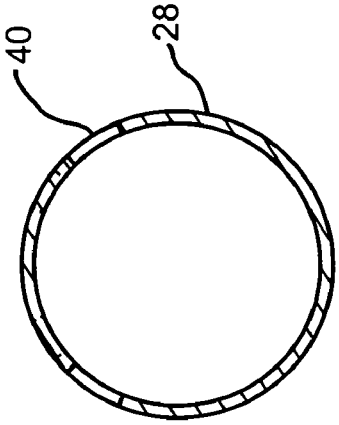
FIG. 5 is a cutaway view of the duct along line 5-5 of FIG. 4.
Figure 4:
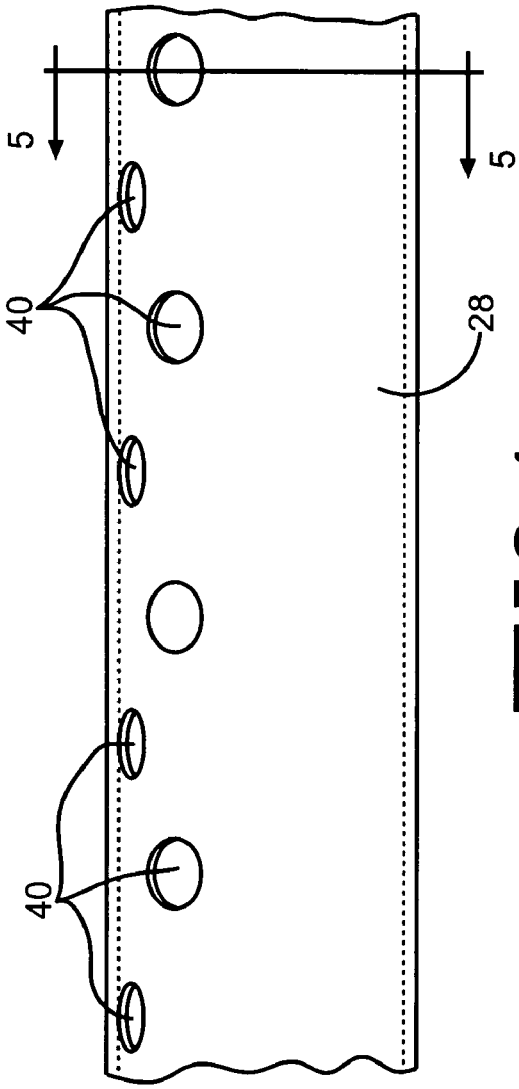
FIG. 4 is a side view of a portion of the duct.

The shape of the ducts 26 and 28 is shown in FIGS. 4 and 5. The ducts 26 and 28 are basically long, round pipes that run through the caissons 20 above the water level. FIGS. 4 and 5 show that these pipes have openings 40 in the top to allow the air to escape into the caissons 20 when the high pressure blower 30 is pumping air into the duct 26 and 28 and when the high pressure blower 30 ceases to pump air into the duct 26 and 28 and the blower valve 34 opens and the pressure release valve 32 opens, and air from the caissons 20 then rushes through these openings 40 and out the pressure release valve 32 and the blower valve 34. The openings 40 in the ducts 26 and 28 are placed at the top of the ducts 26 and 28 so that the air, when pumped through the duct 26 and 28, and escapes out these openings 40, will make contact with the ceiling of the caisson 20 and spread down thus causing the air to spread out over the full surface of the water within the caisson 20. This improves the pneumatic efficiency and allows for less air to be used. The openings 40 can actually be placed anywhere on the ducts 26 and 28, however, as I pointed out above, although it would work and create the waves it is less efficient than placing the openings 40 on the top of the duct 26 and 28.

FIG. 6 shows the pressure release valve 32. Each duct 26 and 28 as shown in FIG. 1 has a pressure release valve 32. The pressure release valve 32, as shown in FIG. 6, is cylindrical and contains a butterfly valve flap 42. When air is being injected into the ducts 26 and 28 by the high pressure blower 30, the butterfly flap 42 is closed not allowing the air to escape out the pressure release valve 32. When the high pressure blower 30 ceases to inject air into the duct 26 and 28, the butterfly valve flap 42 opens and allows the air to escape out the pressure release valve 32. As I stated above, the pressure release valve 32 and the blower valve 34 opens the duct 26 or 28 at the same time to allow the air to escape out. Unlike the previous state of the art, the ducts 26 and 28 have both ends of it that can open to allow the air to escape whereas the previous art had only one opening to allow the air to escape. This double opening allows the system to be more pneumatically efficient. The pressure relief valve 32 and the blower valve are all controlled by an electronic control system. This system can be hooked up to the pressure relief valves 32 and the blower valves 34 by wires of by radio waves.

FIG. 3 shows the high pressure blower 30. In the preferred embodiment the high pressure blower 30 is placed at the side of the pool, below the water line such that it exhausts into the ducts 26 and 28 just above the water line. By placing the high pressure blower 30 in this configuration, the deck area 44 at the deep portion 14 of the pool 12 does not raise significantly above the water level. This configuration has been sought by the industry. In the prior art the housing in which the caissons are deployed are relatively large and raise above the deck at the deep end the pool an undesirable height. As a result, steps must be incorporated into the pool deck in order to allow the user to transverse the perimeter of the pool. In addition, the high housing of the caissons at the deep end of the pool may interfere with the placement of the competitive starting box in the pool, and thereby defeat or inhibit the capacity of the pool to serve as a venue for competitive swimming meets. Finally, high caisson housing is esthetically displeasing. Wave generators providing essential functional utility, yet having a lower vertical height compatible with providing a uniform deck area surrounding the pool is accordingly desired by the industry.

The high pressure blower 30 can be run by an electrical motor or an internal combustion engine. The internal combustion engine can be run from natural gas, propane or gasoline.

The wave generator for this system has been basically designed for a small system.

Figure 7:
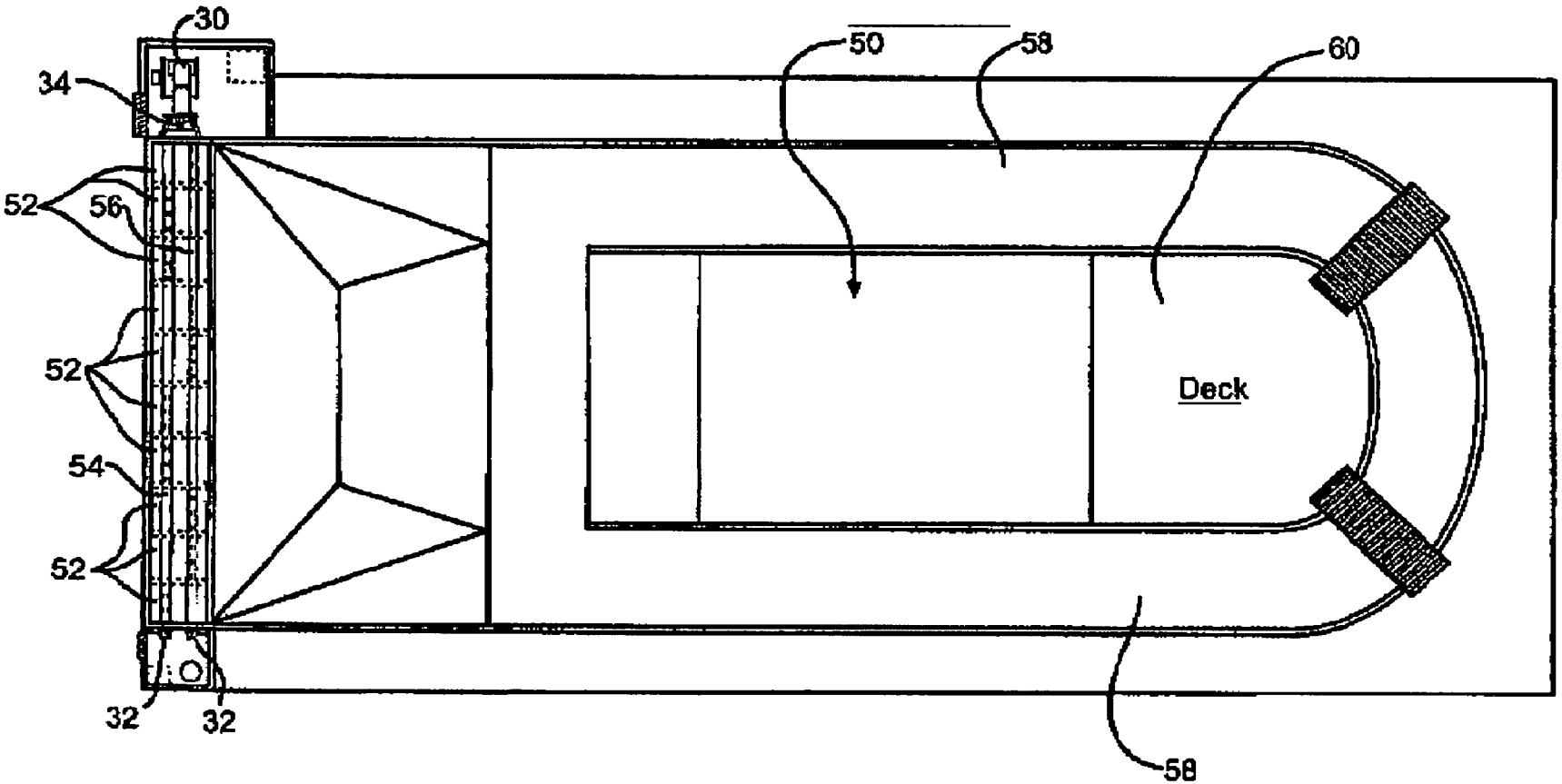
FIG. 7 is a top view of another embodiment of a wave pool with a river around the pool.
Figure 7A:
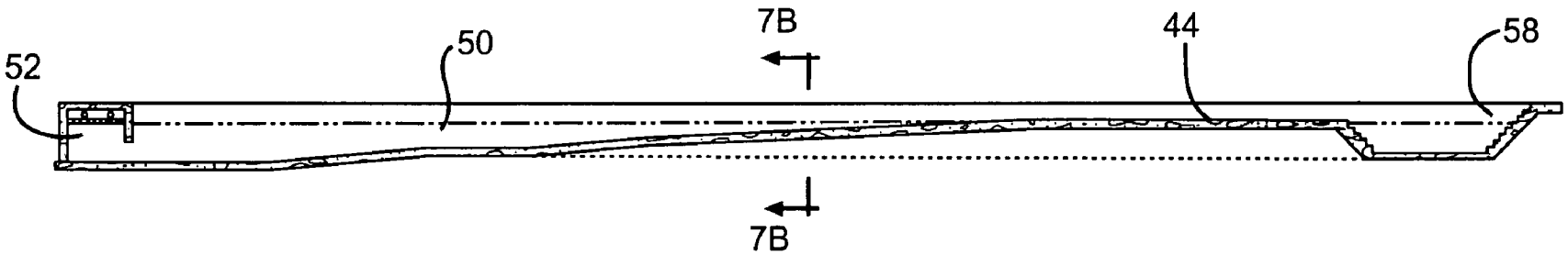
FIG. 7A is a cutaway side view of the wave pool of FIG. 7.
Figure 7B:
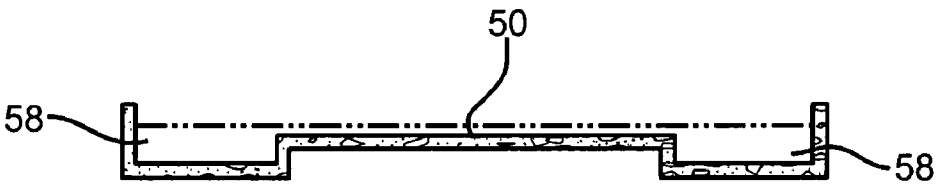
FIG. 7B is a cutaway view of the wave pool of FIG. 7 along line 7B-7B of FIG. 7A.

FIG. 7 shows a pool 50 for a commercial establishment that has ten caissons 52. The caissons 52 also in this pool 50 are driven just like the previous pool 12 from a high pressure blower 30 at the side that distributes the air in two ducts 54 and 56, one of which has openings in each caisson 52. The blower valve 34 and high pressure blower 30 are similar to the five caisson pool 12 except the ten caissons 52 are for a larger establishment. FIG. 7 is also unique because it not only shows a wave pool 50 but also a river 58 that flows around the pool 50, with a deck 60 in the middle of the pool 50 that allows individuals to either enter the river 58 or the wave pool 50. FIG. 7*a* is a cut-away view of FIG. 7 showing the water line. FIG. 7*b* shows the water line for the wave pool 50 and the river 58. The wave pool 50 is similar to the wave pool 12 cross section shown in FIG. 2 and it stops at the deck area 60 at zero depth. However, further out past the deck area 60 another area of water for the river 58 is created. Thus and individual cannot only ride the waves but also ride through the river 58 in his tube or raft. FIG. 7 cut along line 7*b-b* or FIG. 7*a* shows a cut-away view of the system showing that the river runs 58 on both sides of the wave pool 50. FIGS. 7*a* and 7*b* shows the bottom construction of this pool.

Figure 8:
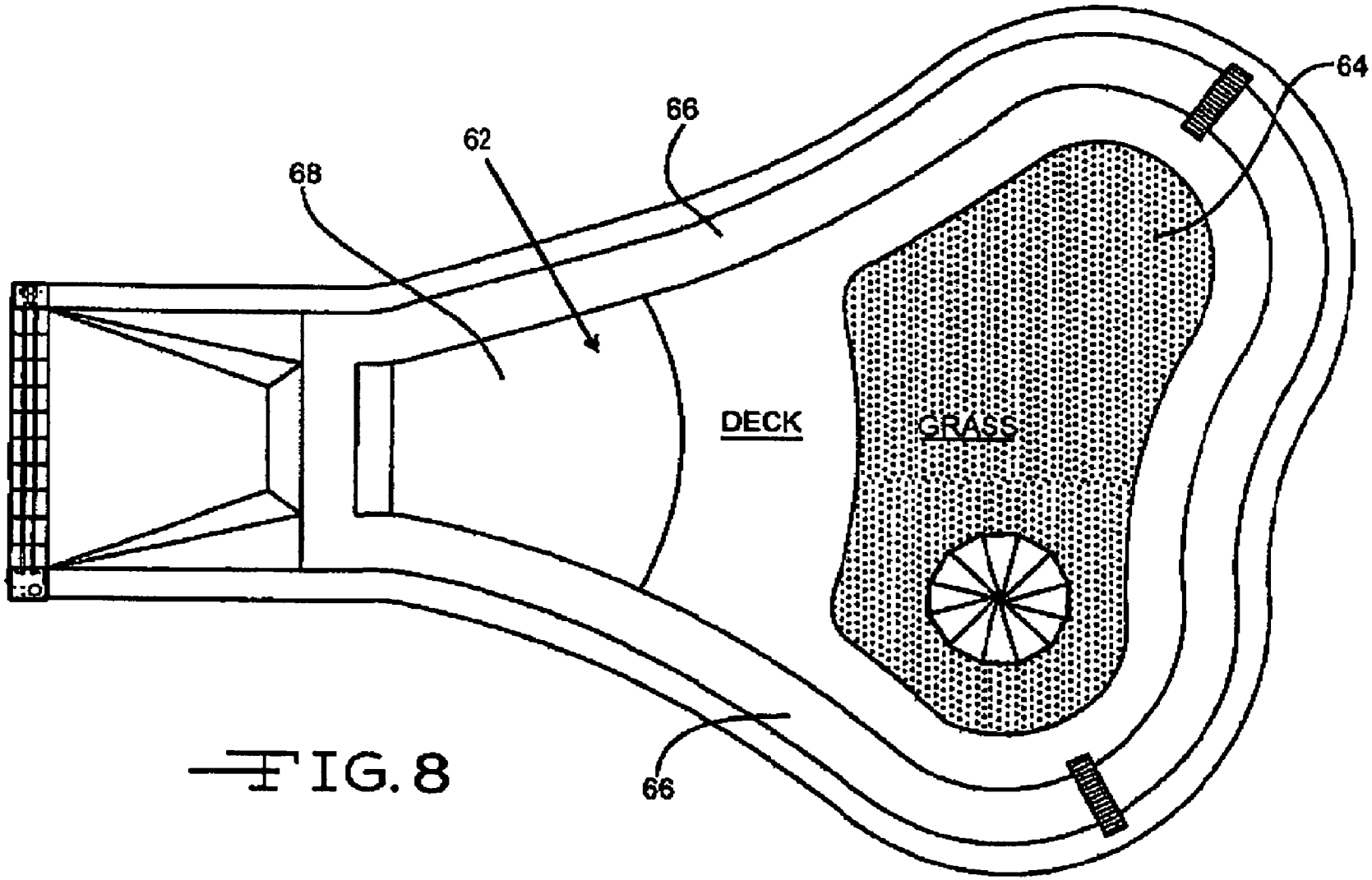
FIG. 8 is a top view of another embodiment of a wave pool with a longer fan shaped river around the pool.

FIG. 8 shows another configuration for a wave pool 62. This configuration has a much more extensive deck 64 and a much larger river 66. That too is operated with ten caissons 52 and the duct 54 and 56 similar to the wave pool 12 and 50 of FIG. 1 and FIG. 7. However, in this one the wave pool 62 and the river 66 are outstretched in a fan shape. The deck 64 area is greatly enhanced so that individuals will have a longer ride on the river 66. The wave pool 62 area fans out just as in FIG. 1.

Figure 10:
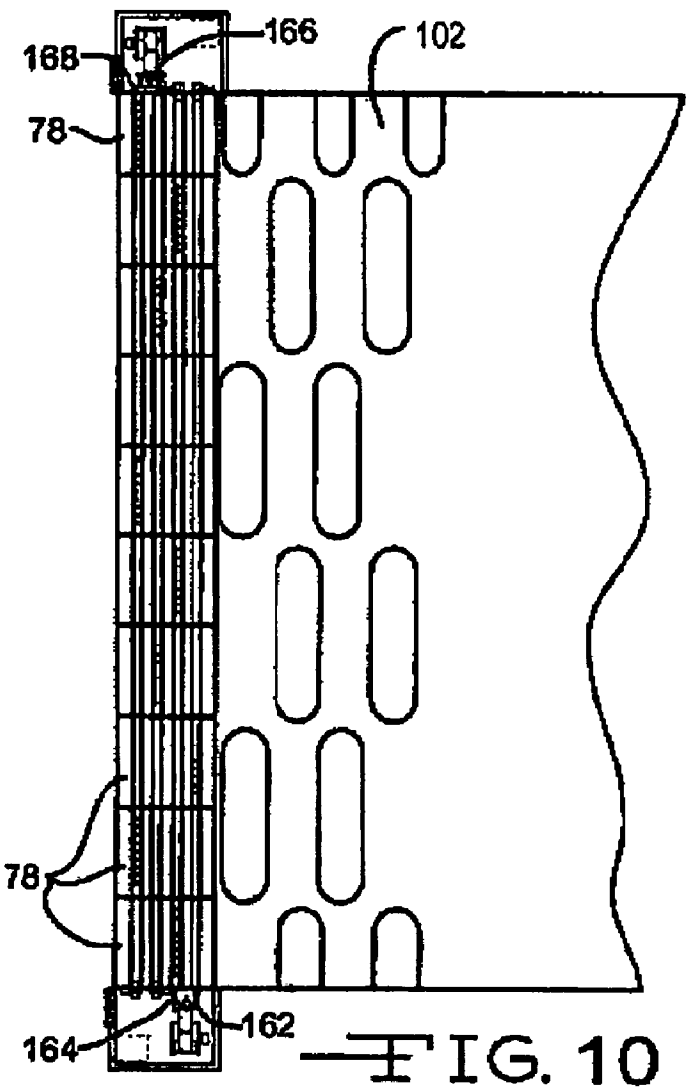
FIG. 10 shows the same configuration of blowers, ducts and caissons as FIG. 9 and a different pattern of wave from FIG. 9 that can be created by this configuration of ducts and blowers.
Figure 9:
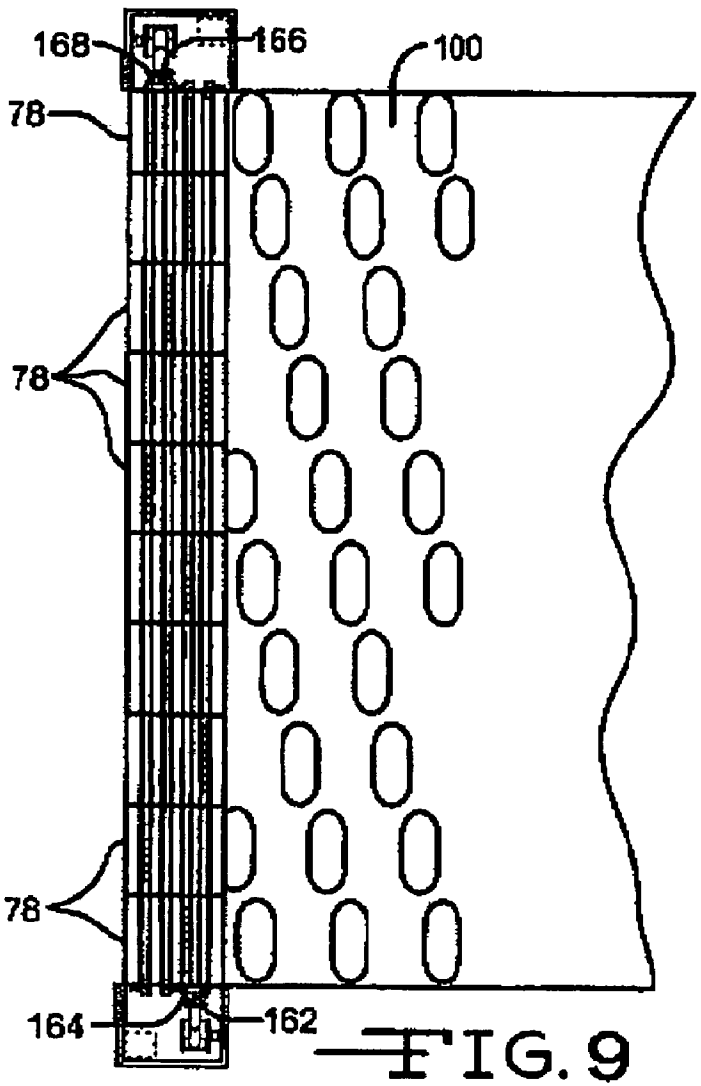
FIG. 9 shows the blower and caisson area of another embodiment of the wave pool and a pattern of wave that can be created by this configuration of ducts and blowers.

FIGS. 9 and 10 show another configuration for ducts 162, 164, 166, and 168 and the caissons 78. In this system a high pressure blower 30 could be placed at each end of the wave pool 68 and the set of caissons 78. The high pressure blower 30 still pressurizes two ducts 162 and 164 or 166 and 168 that run across all ten of the caissons 78. The ducts 162, 164, 166, and 168 have the perforated tops in every fourth caisson 78 rather than in every other caisson 20 and 52 as in the previous configurations. The another high pressure blower 80 also has two ducts 74 and 76 out of it and it too has the perforations on the duct in every fourth caisson 78. Thus, there are four ducts 162, 164, 166, and 168 to every caisson 78; however, only one of those ducts 162, 164, 166, or 168 is perforated in each caisson.

Configuring the caissons 78 in this way, one can produce several different wave patterns. Two of these wave patterns are shown in FIGS. 9 and 10. In FIG. 9 when the first high pressure blower fills ducts 162 and the second high pressure blower fills duct 166 at the same time and ducts 164 of first high pressure blower and duct 168 of second high pressure blower are exhausted at the same time, one begins to produce the wave patterns 100 of FIG. 9. Then duct 164 of first high pressure blower is pressurized while duct 162 is exhausted and duct 168 of second high pressure blower is pressurized while duct 166 is exhausted further creating the wave pattern 100 of FIG. 9.

FIG. 10 is created by pressurizing duct 162 of high pressure blower 160 and duct 168 of high pressure blower 170 while exhausting duct 164 of high pressure blower 160 and duct 166 of high pressure blower 170. Then duct 164 of high pressure blower 160 is pressurized and duct 166 of high pressure blower 170 is pressurized while duct 162 of high pressure blower 160 and duct 168 of high pressure blower 170 exhausted. This will create the wave pattern 102 of FIG. 10.

Figure 11:
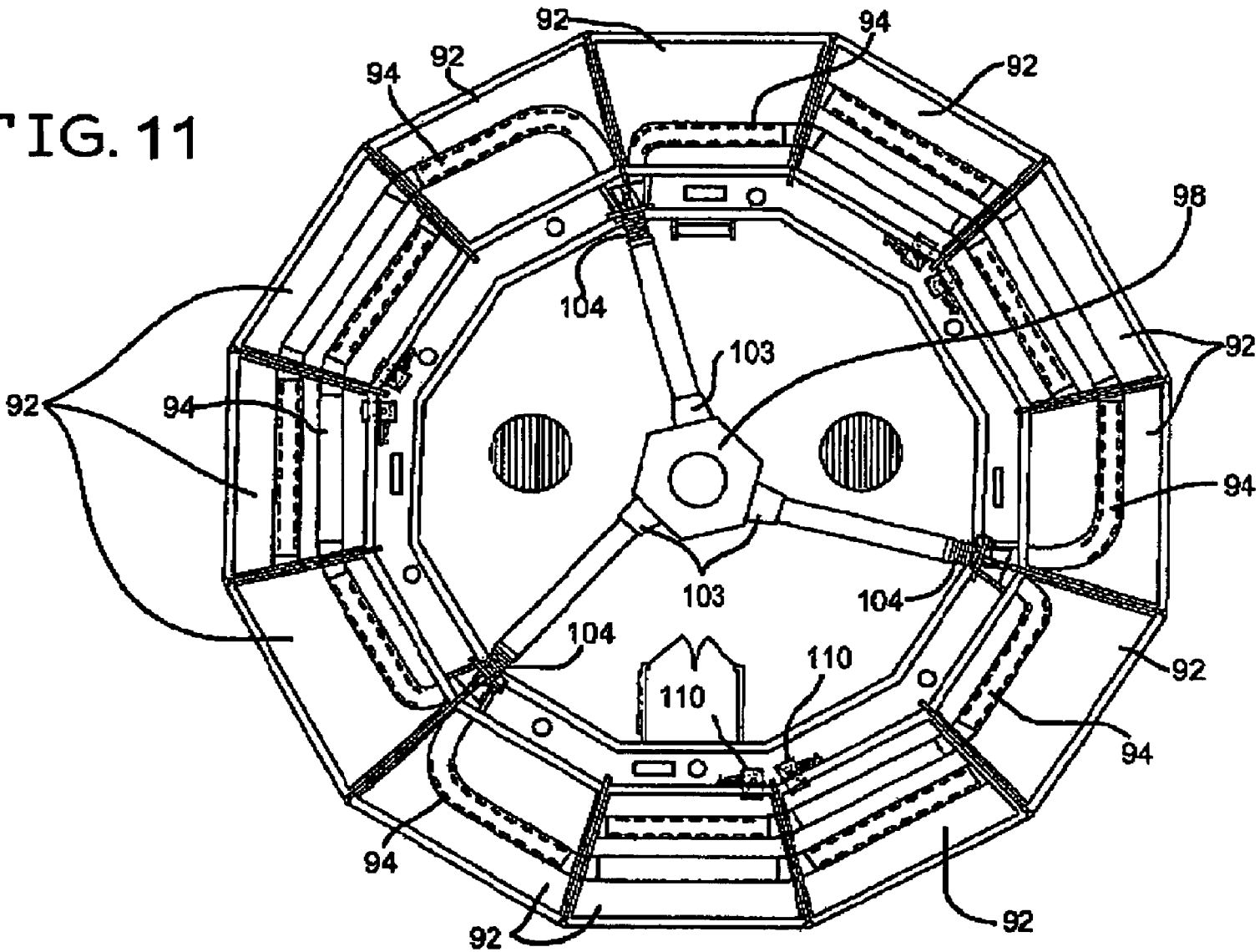
FIG. 11 shows a top view of a circular wave pool.

FIG. 11 shows you that a circular wave pool 90 can also be built. In this configuration there are 12 caissons 92. However, one could use less or more caissons. Each of the caissons 92 contains at least one duct 94 that is perforated. The caisson 92 construction and the way in which the waves are created are exactly the same in this configuration as in the previous configurations. The air from the high pressure blower 98 is forced into the ducts 94 and it escapes into the caisson 92 out of the perforations in the top of the ducts 94. This distributes the air over the water evenly and thus creates high pneumatic efficiency. The air, of course, presses the water downward and the water escapes through the submerged passageway not shown in the example creating the wave. In the configuration shown in FIG. 11 the wave generation system has a horizontal high pressure blower 98 with three outlets 103. Those three outlets 103 deliver air by a non-perforated duct to the blower valve 104. The blower valve 104 is like the previous embodiment in that it is designed to alternately pressurize two ducts 94. The two ducts 94 extend from the high pressure blower 98 in opposite directions in the circular configuration. Each duct 94 runs through three caissons 92 chambers and has perforations in the first and third caissons 92 for which it runs through. Using this configuration there is one perforated duct 94 in each caisson 92. There are many different configurations that could be used in this system. The high pressure blower 98 could have only one outlet to a blower valve as in the previous example that alternately pressurizes two different ducts. These ducts would extend fully around the circular configuration with alternate caissons having perforation. In this configuration there still would be one perforated duct per caisson. The configuration could also have more than three different fan exhausts with ducts running to the caissons. The basic design consideration is that there would be at least one perforated duct in each caisson so that the waves can be produced. In the configuration of FIG. 11 the pressure relief valves 110 are placed in the walls of the caisson in some of the caissons 92. These pressure relief valves 110 work the same as in the previously embodiments. When the blower valve 104 shuts off the flow of air to the caissons the pressure relief valve 110 opens and exhausts the air from the caisson 98. In the caisson that are adjacent to the blower valve 104 there are no pressure relief valves 110. When the blower valve 104 moves from one duct 94 to the other duct 94 it opens up the first duct 94 so that the air can pass back through the perforation and escape out the blower valve 104. As in the previous embodiment the blower valve 104 and the pressure relief valve 110 are hooked to an electronic control system that control there actions.

Changes and modifications in the specifically described embodiments can be carried out without departing from the scope of the invention which is intended to be limited only by the scope of the appending claims.

I claim:

1. A pneumatic wave generator, comprising:

a. a high pressure blower that can produce a large volume of high pressure air; and, b. a means for powering the high pressure blower; and, c. at least one caisson with walls and a ceiling and with an upper and lower portion and an open passage at the lower portion; and, d. a duct that carries the high pressure air from the high pressure blower to the upper portion of the caisson; and, e. a means to evenly distribute the air over the entire upper portion of the caisson is that the duct from the high pressure blower is extended into the caisson and has more than two openings which allows the air to move from the duct evenly into the caisson; and, f. a means to shut off or allow the flow of air from the high pressure blower to the caisson; and, g. a means to allow the air to escape from the caisson; and, h. a means to control the means to shut off or allow the flow of air from the high pressure blower to the caisson and the means to allow the air to escape from the caisson.

2. A pneumatic wave generator, as in claim 1, wherein:

a. the portion of the duct that extends into the upper portion of the caisson has an upper portion and the openings are placed in the upper portion of the duct and these openings allow the air to move from the duct evenly into the caisson.

3. A pneumatic wave generator, as in claim 1, wherein:

a. the means to allow the air to escape from the caisson comprises;

1. the duct pass completely through the caisson and through the wall of the caisson and the duct has an end and the end is the portion of the duct that has past through the wall; and 2. a pressure relief valve attach to the end duct; and 3. whereas when the pressure relief valve is closed no air escapes through the pressure relief valve from the caisson and when the pressure relief valve is open the high pressure air in the caisson passes through the openings in the duct and into and through the pressure relief valve escaping from the caisson.

4. A pneumatic wave generator, as in claim 1, further comprising:

a. there is more than one caisson; and, b. a first duct that ducts the high pressure air from the high pressure blower to the caissons and the first duct has openings on the top of the duct in the first caisson it passes through and has openings on the top of the duct in every other caisson it passes through; and, c. a second duct that ducts the high pressure air for the high pressure blower to the caisson, and the second duct has openings on the top of the duct in the second caisson it passes through and has openings on the top of the duct in every other caisson it passes through; and, d. a valve between the high pressure blower and the ducts that shuts off the air and allows the air to flow into the ducts is a valve that will shutoff the air to the first duct and delivers the air to the second duct then shutoff the air to the second duct and delivers the air to the first duct by alternating between ducts.

5. A pneumatic wave generator, comprising:

a. a high pressure blower that can produce a large volume of high pressure air; and, b. a means for powering the high pressure blower; and, c. more than one caisson with walls and a ceiling and with an upper and lower portion and an open passage at the lower portion; and, d. a first duct that ducts the high pressure air from the high pressure blower to one of the caissons; and, e. a second duct that ducts the high pressure air from the high pressure blower to a different caisson than the first duct; and, f. a valve between the high pressure blower and the ducts that shuts off the air and allows the air to flow into the ducts is a valve that will shutoff the air to the first duct and delivers the air to the second duct then shutoff the air to the second duct and delivers the air to the first duct by alternating between ducts, g. a means to evenly distribute the air over the entire upper portion the caisson comprising openings on the first and second duct that directs air towards the ceiling of the caisson.

6. A pneumatic wave generator comprising:

a. there are at least four caissons each with walls and ceiling and with an upper and lower portion and an open passage at the lower portion; and, b. a first high pressure blower; and, c. a second high pressure blower d. a first duct that ducts the high pressure air from the first high pressure blower to the caissons and the first duct has openings on the top of the duct in the first caisson it passes through and has openings on the top of the duct in every fourth caisson it passes through; and, e. a second duct that ducts the first high pressure air for the high pressure blower to the caisson, and the second duct has openings on the top of the duct in the third caisson it passes through and has openings on the top of the duct in every fourth caisson it passes through; and, f. a third duct that ducts the high pressure air from the second high pressure blower to the caissons and the third duct has openings on the top of the duct in the second caisson it passes through and has openings on the top of the duct in every fourth caisson it passes through; and, g. a fourth duct that ducts the high pressure air from the second high pressure blower to the caissons and the fourth duct has openings on the top of the duct in the fourth caisson it passes through and has openings on the top of the duct in every fourth caisson it passes through; and, h. a valve between the first high pressure blower and first and second ducts that shuts off the air and allows the air to flow into the first and second ducts is a valve that will shutoff the air to the first duct and delivers the air to the second duct then shutoff the air to the second duct and delivers the air to the first duct by alternating between ducts, i. a valve between the second high pressure blower and the third and forth ducts that shuts off the air and allows the air to flow into the ducts is a valve that will shutoff the air to the third duct and delivers the air to the fourth duct then shutoff the air to the fourth duct and delivers the air to the third duct by alternating between ducts: and, j. whereas, if the valve for the first duct and the second duct allows the air flow to the first duct and shutoff the air flow to the second duct and the valve to the third and fourth duct allows the air to flow to third duct and shutoff the air flow to the fourth duct the wave produced will have the length of two caissons and if the valve for the first duct and the second duct allows the air flow to the second duct and shutoff the air flow to the first duct and the valve to the third and fourth duct allows the air to flow to fourth duct and shutoff the air flow to the third duct the wave produced will have the length of one caisson; and, k. a mean for powering the first and second high pressure blower; and, l. a means to evenly distribute the air over the entire upper portion the caisson comprising openings on the first, second, third and fourth duct that directs air towards the ceiling of the caisson.

* * * * *